US012692114B2

(12) United States Patent
Ogawa

(10) Patent No.: US 12,692,114 B2
(45) Date of Patent: Jul. 28, 2026

(54) SHEET CONVEYING DEVICE CAPABLE OF CORRECTING POSITION OF CONVEYED SHEET, IMAGE FORMING APPARATUS, AND OPERATION CONTROL METHOD

(71) Applicant: KYOCERA Document Solutions Inc., Osaka (JP)

(72) Inventor: Kotaro Ogawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 265 days.

(21) Appl. No.: 18/634,818

(22) Filed: Apr. 12, 2024

(65) Prior Publication Data

US 2024/0343515 A1 Oct. 17, 2024

(30) Foreign Application Priority Data

Apr. 14, 2023 (JP) ..... 2023-066136

(51) Int. Cl.
*B65H 9/00* (2006.01)
*B65H 5/06* (2006.01)

(52) U.S. Cl.
CPC ..... *B65H 9/002* (2013.01); *B65H 5/062* (2013.01); *B65H 2404/1424* (2013.01); *B65H 2557/64* (2013.01)

(58) Field of Classification Search
CPC ..... B65H 9/00; B65H 9/002; B65H 5/062; B65H 2404/1424; B65H 2557/64
USPC ..... 271/184
See application file for complete search history.

(56) References Cited

U.S. PATENT DOCUMENTS

| | | | | |
|---|---|---|---|---|
| 7,581,725 | B2 * | 9/2009 | Fujita | B65H 31/34 270/58.11 |
| 8,820,738 | B2 * | 9/2014 | Deno | B65H 9/006 271/272 |
| 9,671,739 | B2 * | 6/2017 | Yamakawa | B65H 9/103 |
| 11,180,334 | B2 * | 11/2021 | Matsumoto | B65H 5/062 |
| 12,037,218 | B2 * | 7/2024 | Ando | B65H 83/02 |

FOREIGN PATENT DOCUMENTS

JP 2009137710 A 6/2009

* cited by examiner

*Primary Examiner* — Leslie A Nicholson, III
(74) *Attorney, Agent, or Firm* — Alleman Hall LLP

(57) ABSTRACT

A sheet conveying device includes a pair of conveying members, a detection processing portion, a first movement processing portion, and a second movement processing portion. The pair of conveying members nip and convey a sheet, the pair of conveying members being movably provided along a width direction of the sheet. The detection processing portion detects a deviation amount of the sheet conveyed by the pair of conveying members in the width direction. The first movement processing portion causes the pair of conveying members that are nipping the sheet to move along the width direction based on the detected deviation amount. The second movement processing portion causes, when determined that a movement condition is satisfied in a case of moving the pair of conveying members, the pair of conveying members that have finished conveying the sheet to move to a reference position.

5 Claims, 4 Drawing Sheets

SHEET CONVEYING DEVICE CAPABLE OF CORRECTING POSITION OF CONVEYED SHEET, IMAGE FORMING APPARATUS, AND OPERATION CONTROL METHOD

INCORPORATION BY REFERENCE

This application is based upon and claims the benefit of priority from the corresponding Japanese Patent Application No. 2023-066136 filed on Apr. 14, 2023, the entire contents of which are incorporated herein by reference.

BACKGROUND

The present disclosure relates to a sheet conveying device, an image forming apparatus, and an operation control method.

In an image forming apparatus such as a printer, regarding a sheet conveyed along a predetermined conveying direction, a positional deviation in which a position of the sheet in a width direction orthogonal to the conveying direction is deviated may occur. In contrast, there is known, as a related art, an image forming apparatus in which the position of the sheet in the width direction is corrected using a pair of conveying members movably provided along the width direction. In the image forming apparatus according to the related art, the pair of conveying members are moved to a predetermined reference position every time the position of the sheet in the width direction is corrected by using the pair of conveying members.

SUMMARY

A sheet conveying device according to an aspect of the present disclosure includes: a pair of conveying members, a detection processing portion, a first movement processing portion, a determination processing portion, and a second movement processing portion. The pair of conveying members nip and convey a sheet, the pair of conveying members being movably provided along a width direction of the sheet orthogonal to a conveying direction of the sheet. The detection processing portion detects a deviation amount of the sheet conveyed by the pair of conveying members in the width direction. The first movement processing portion causes the pair of conveying members that are nipping the sheet to move along the width direction based on the deviation amount detected by the detection processing portion. The determination processing portion determines whether or not a predetermined movement condition is satisfied when the pair of conveying members are moved by the first movement processing portion. The second movement processing portion causes, when determined by the determination processing portion that the movement condition is satisfied, the pair of conveying members that have finished conveying the sheet to move to a predetermined reference position.

An image forming apparatus according to another aspect of the present disclosure includes: the sheet conveying device; and an image forming portion. The image forming portion forms an image on the sheet conveyed by the sheet conveying device.

An operation control method according to another aspect of the present disclosure is executed in a sheet conveying device including a pair of conveying members which nip and convey a sheet, the pair of conveying members being movably provided along a width direction of the sheet orthogonal to a conveying direction of the sheet, and includes: a detection step, a first movement step, a determination step, and a second movement step. The detection step includes detecting a deviation amount of the sheet conveyed by the pair of conveying members in the width direction. The first movement step includes causing the pair of conveying members that are nipping the sheet to move along the width direction based on the deviation amount detected by the detection step. The determination step includes determining whether or not a predetermined movement condition is satisfied when the pair of conveying members are moved by the first movement step. The second movement step includes causing, when determined by the determination step that the movement condition is satisfied, the pair of conveying members that have finished conveying the sheet to move to a predetermined reference position.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, an embodiment of the present disclosure will be described with reference to the attached drawings. It is noted that the following embodiment is an example of embodying the present disclosure and does not limit the technical scope of the present disclosure.

Configuration of Image Forming Apparatus 100

First, a configuration of an image forming apparatus 100 according to the embodiment of the present disclosure will be described with reference to FIG. 1 and FIG. 2.

It is noted that for convenience of descriptions, a vertical direction in a state where the image forming apparatus 100 is installed in a usable state (a state shown in FIG. 1) is defined as an up-down direction D1. In addition, a front-rear direction D2 is defined with a surface of the image forming apparatus 100 on a near side of a sheet surface shown in FIG. 1 being a front surface (front side). In addition, a left-right direction D3 is defined using the front surface of the image forming apparatus 100 in the installed state as a reference.

Figure 3:
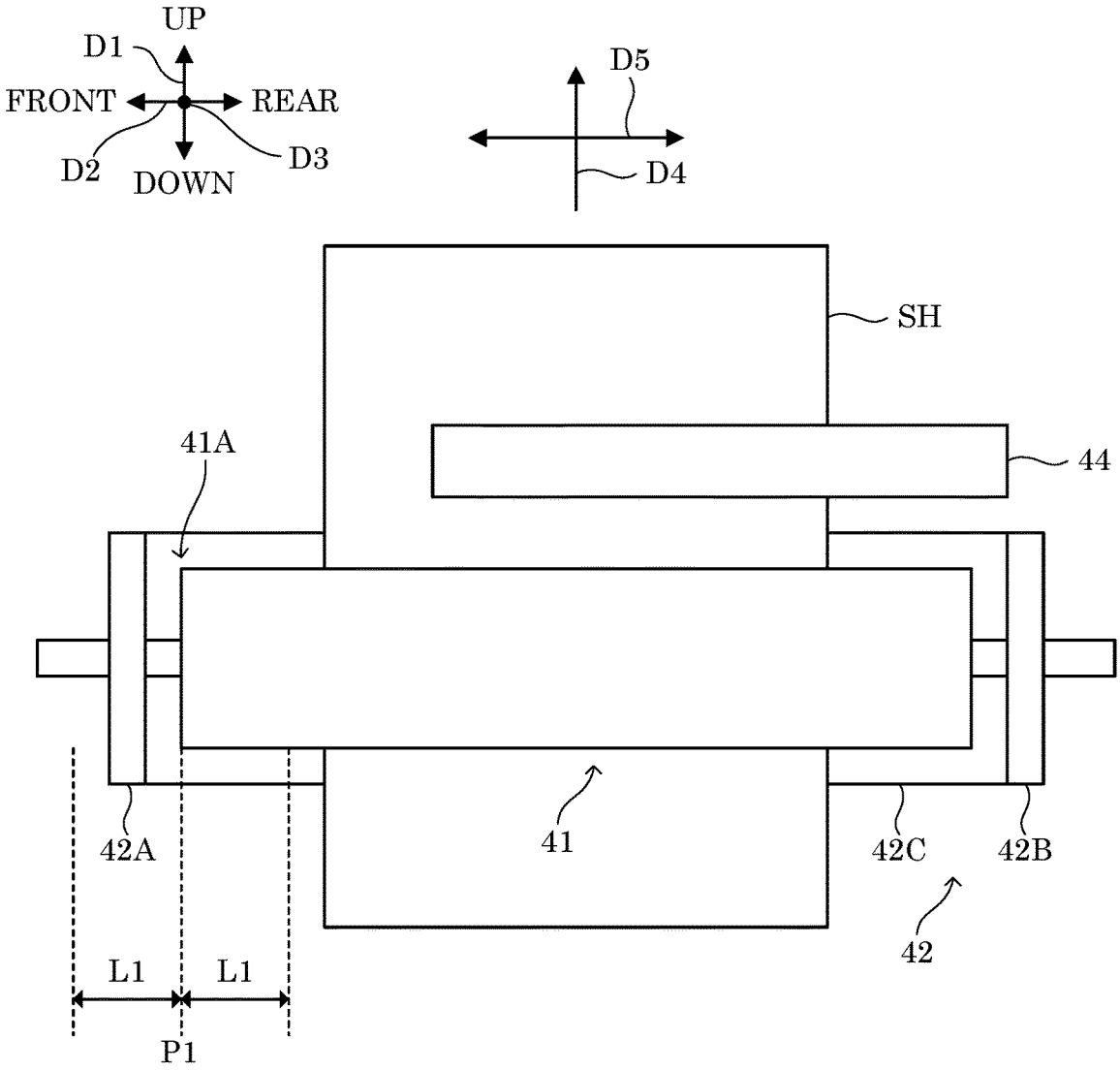
FIG. 3 is a right side view showing a configuration of a correction roller pair in the image forming apparatus according to the embodiment of the present disclosure.

The image forming apparatus 100 is an image processing apparatus having a printing function for forming an image that is based on image data on a sheet SH (see FIG. 3). Specifically, the image forming apparatus 100 is a multifunction peripheral having a plurality of functions including the printing function. It is noted that the image forming apparatus according to the present disclosure may alternatively be a printer, a facsimile apparatus, or a copying machine having the printing function.

Figure 1:
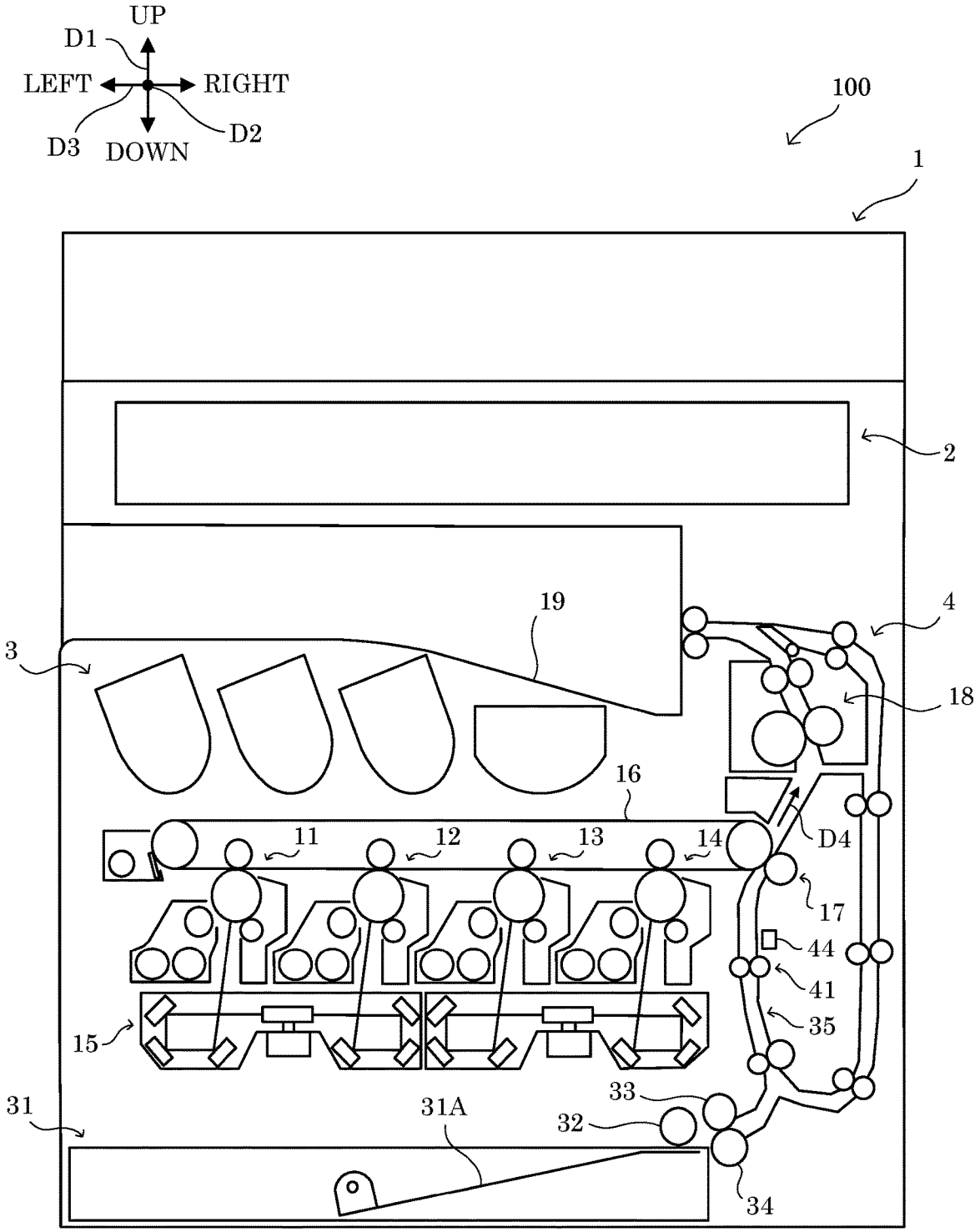
FIG. 1 is a cross-sectional view showing a configuration of an image forming apparatus according to an embodiment of the present disclosure.
Figure 2:
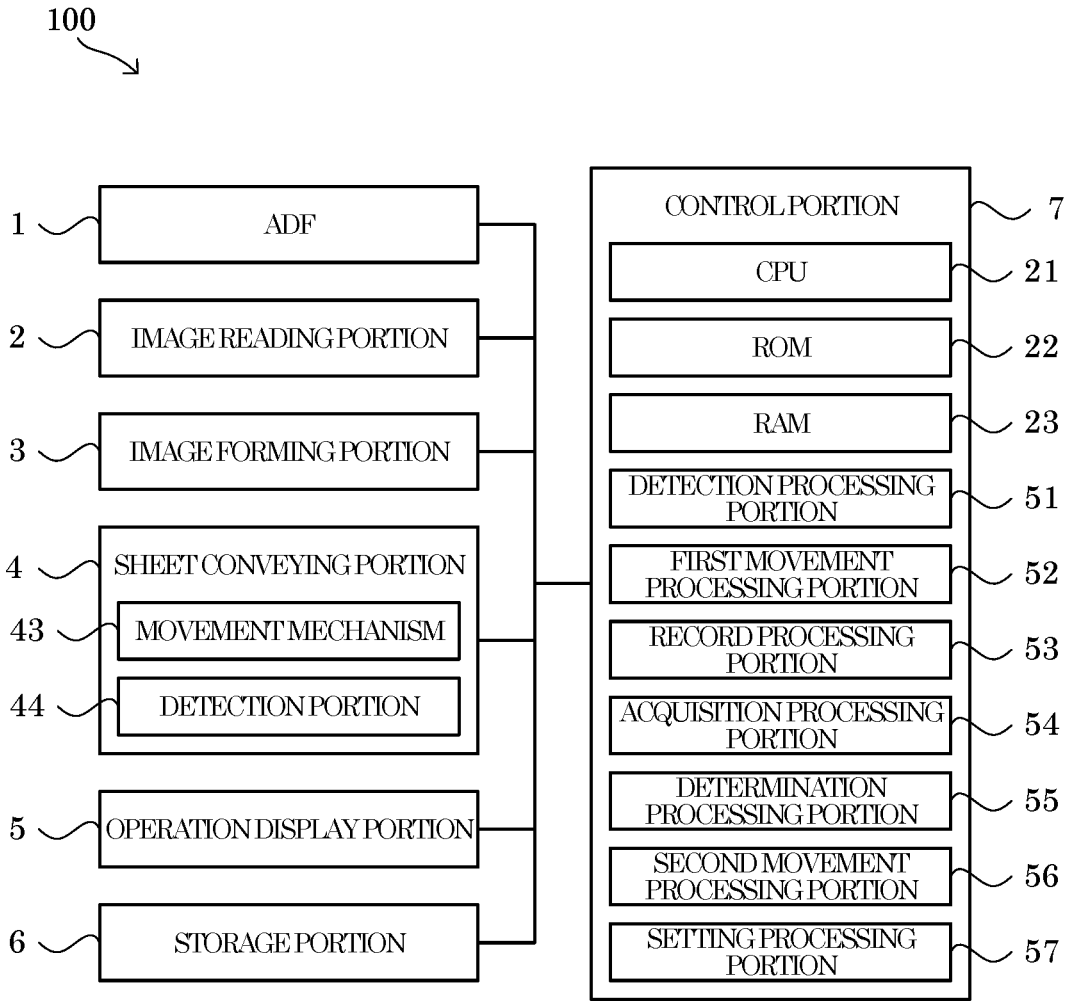
FIG. 2 is a block diagram showing a system configuration of the image forming apparatus according to the embodiment of the present disclosure.

As shown in FIG. 1 and FIG. 2, the image forming apparatus 100 includes an ADF (Auto Document Feeder) 1, an image reading portion 2, an image forming portion 3, a sheet conveying portion 4, an operation display portion 5, a storage portion 6, and a control portion 7.

The ADF 1 conveys a document sheet whose image is to be read by the image reading portion 2. The ADF 1 includes a document sheet setting portion, a plurality of conveying rollers, a document sheet holder, and a sheet discharge portion.

The image reading portion 2 realizes a scanning function for reading an image of a document sheet. The image reading portion 2 includes a document sheet table, a light source, a plurality of mirrors, an optical lens, and a CCD (Charge Coupled Device).

The image forming portion 3 realizes the printing function. Specifically, the image forming portion 3 forms a color or monochrome image on the sheet SH (see FIG. 3) conveyed by the sheet conveying portion 4 using electrophotography. It is noted that the image forming portion 3 may alternatively form an image on the sheet SH conveyed by the sheet conveying portion 4 using an inkjet system.

As shown in FIG. 1, the image forming portion 3 includes a plurality of image forming units 11 to 14, a laser scanning unit 15, an intermediate transfer belt 16, a secondary transfer roller 17, a fixing device 18, and a sheet discharge tray 19. The image forming unit 11 forms a toner image on the intermediate transfer belt 16 using Y (yellow) toner. The image forming unit 12 forms a toner image on the intermediate transfer belt 16 using C (cyan) toner. The image forming unit 13 forms a toner image on the intermediate transfer belt 16 using M (magenta) toner. The image forming unit 14 forms a toner image on the intermediate transfer belt 16 using K (black) toner. The plurality of image forming units 11 to 14 each include a photoconductor drum, a charging roller, a developing device, a primary transfer roller, and a drum cleaning portion. The laser scanning unit 15 emits light that is based on image data toward a surface of the photoconductor drum of each of the image forming units 11 to 14. A toner image formed on the surface of the photoconductor drum of each of the image forming units 11 to 14 is transferred onto the intermediate transfer belt 16. The secondary transfer roller 17 transfers the toner images transferred onto a surface of the intermediate transfer belt 16 onto the sheet SH (see FIG. 3) conveyed by the sheet conveying portion 4. The fixing device 18 fixes the toner images transferred onto the sheet SH by the secondary transfer roller 17 to the sheet SH. The sheet SH on which the toner images have been fixed by the fixing device 18 is discharged onto the sheet discharge tray 19.

The sheet conveying portion 4 conveys the sheet SH (see FIG. 3) on which an image is to be formed by the image forming portion 3.

The operation display portion 5 is a user interface of the image forming apparatus 100. The operation display portion 5 includes a display portion and an operation portion. The display portion displays various types of information in response to control instructions from the control portion 7. For example, the display portion is a liquid crystal display. The operation portion is used to input various types of information to the control portion 7 according to user operations. For example, the operation portion is a touch panel.

The storage portion 6 is a non-volatile storage device. For example, the storage portion 6 is a flash memory. It is noted that the storage portion 6 may alternatively be an SSD (Solid State Drive) or an HDD (Hard Disk Drive).

The control portion 7 collectively controls the image forming apparatus 100. It is noted that the control portion 7 may alternatively be a control portion provided separate from a main control portion which collectively controls the image forming apparatus 100.

As shown in FIG. 2, the control portion 7 includes a CPU 21, a ROM 22, and a RAM 23. The CPU 21 is a processor which executes various types of calculation processing. The ROM 22 is a non-volatile storage device in which information such as control programs for causing the CPU 21 to execute various types of processing is stored in advance. The RAM 23 is a volatile or non-volatile storage device that is used as a temporary storage memory (working area) for the various types of processing to be executed by the CPU 21. The CPU 21 executes the various control programs stored in advance in the ROM 22 to thus collectively control the image forming apparatus 100. It is noted that the control portion 7 may alternatively be constituted of an electronic circuit such as an integrated circuit (ASIC).

Configuration of Sheet Conveying Portion 4

Next, a configuration of the sheet conveying portion 4 will be described with reference to FIG. 1 to FIG. 3.

As shown in FIG. 1 to FIG. 3, the sheet conveying portion 4 includes a sheet feed cassette 31, a pickup roller 32, a sheet feed roller 33, a separation roller 34, a sheet conveying path 35, a correction roller pair 41, a movement mechanism 43, and a detection portion 44.

The sheet feed cassette 31 stores the sheet SH (see FIG. 3) on which an image is to be formed by the image forming portion 3. For example, the sheet feed cassette 31 stores the sheet SH such as a paper sheet, coated paper, a postcard, an envelope, and an OHP sheet.

A lift plate 31A (see FIG. 1) liftable in the up-down direction D1 is provided at a bottom portion of the sheet feed cassette 31. The lift plate 31A lifts a sheaf of sheets SH stored in the sheet feed cassette 31 to a contact position at which it comes into contact with the pickup roller 32.

The pickup roller 32 is provided above the sheet feed cassette 31. The pickup roller 32 comes into contact with an uppermost sheet SH out of the sheaf of sheets SH lifted by the lift plate 31A and conveys the sheet SH to the sheet feed roller 33.

The sheet feed roller 33 comes into contact with an upper surface of the sheet SH conveyed by the pickup roller 32 and coveys the sheet SH along the sheet conveying path 35.

The separation roller 34 is provided below the sheet feed roller 33. The separation roller 34 is biased toward the sheet feed roller 33 by a bias member (not shown). Thus, a sheet feed nip portion for nipping the sheet SH is formed between the sheet feed roller 33 and the separation roller 34. When a plurality of sheets SH are conveyed to the sheet feed nip portion, the separation roller 34 separates, out of the plurality of sheets SH, other sheets SH from the sheet SH in contact with the sheet feed roller 33.

The sheet conveying path 35 is a movement path for the sheet SH, which leads from the sheet feed cassette 31 to the sheet discharge tray 19 via the secondary transfer roller 17 and the fixing device 18. The sheet feed roller 33 and the separation roller 34 are provided on the sheet conveying path 35. In addition, a plurality of conveying roller pairs including the correction roller pair 41 are provided on the sheet conveying path 35 with intervals provided therebetween. On the sheet conveying path 35, the sheet SH is conveyed in a conveying direction D4 shown in FIG. 1 by the sheet feed roller 33 and the plurality of conveying roller pairs. The conveying direction D4 is a direction along a plane orthogonal to the front-rear direction D2.

The correction roller pair 41 nips and conveys the sheet SH.

As shown in FIG. 1, the correction roller pair 41 is provided more on an upstream side of the conveying direction D4 than the secondary transfer roller 17 on the sheet conveying path 35. The correction roller pair 41 is constituted of a drive roller which rotates upon receiving a driving force supplied from a motor (not shown) and a driven roller which is provided opposed to the drive roller. The driven roller is biased toward the drive roller by a bias member (not shown). Thus, a conveying nip portion for nipping the sheet SH is formed between the drive roller and the driven roller.

In the image forming apparatus 100, regarding the sheet SH conveyed along the conveying direction D4, a positional deviation in which a position of the sheet SH in a width direction D5 (see FIG. 3) orthogonal to the conveying direction D4 is deviated may occur. In contrast, in the image forming apparatus 100, the position of the sheet SH in the width direction D5 is corrected using the correction roller pair 41.

Specifically, the correction roller pair 41 is movably provided along the width direction D5 (see FIG. 3). The correction roller pair 41 is an example of a pair of conveying members according to the present disclosure.

For example, the correction roller pair 41 is rotatably supported by a support portion 42 (see FIG. 3) movably provided along the width direction D5.

As shown in FIG. 3, the support portion 42 includes a first wall portion 42A, a second wall portion 42B, and a coupling portion 42C. The first wall portion 42A is formed in a form of a flat plate having a thickness in the front-rear direction D2 and rotatably supports a front-side rotation shaft of the drive roller and a front-side rotation shaft of the driven roller. The second wall portion 42B is formed in a form of a flat plate opposing the first wall portion 42A in the front-rear direction D2 and rotatably supports a rear-side rotation shaft of the drive roller and a rear-side rotation shaft of the driven roller. The coupling portion 42C is formed in a form of a flat plate that is elongated in the front-rear direction D2 and has a thickness in the left-right direction D3, and supports a left end portion of the first wall portion 42A and a left end portion of the second wall portion 42B.

The support portion 42 is supported while being movable in the width direction D5 by a housing of the image forming apparatus 100. In addition, the correction roller pair 41 is provided while being integrally movable with the support portion 42. Thus, when the support portion 42 is moved in the width direction D5, the correction roller pair 41 supported by the support portion 42 also moves in the width direction D5.

For example, the correction roller pair 41 is provided such that a front-side end portion 41A (see FIG. 3) of the correction roller pair 41 becomes movable from a reference position P1 (see FIG. 3) toward both sides of the width direction D5 by a distance L1.

The movement mechanism 43 causes the correction roller pair 41 to move along the width direction D5. Specifically, the movement mechanism 43 includes a motor that generates a driving force for moving the correction roller pair 41 and the support portion 42 and a power transmission mechanism that transmits the driving force generated by the motor to the support portion 42. The support portion 42 is moved along the width direction D5 by the driving force transmitted from the movement mechanism 43.

The detection portion 44 is used to detect a deviation amount of the sheet SH conveyed by the correction roller pair 41 in the width direction D5.

As shown in FIG. 1 and FIG. 3, the detection portion 44 is provided more on a downstream side of the conveying direction D4 than the correction roller pair 41 on the sheet conveying path 35.

Specifically, the detection portion 44 is a contact image sensor (CIS) that is capable of detecting a position of one of end portions of the conveyed sheet SH in the width direction D5 (the rear-side end portion in the front-rear direction D2). When the sheet SH passes through a detection position by the detection portion 44, the detection portion 44 detects a position of one of the end portions of the sheet SH in the width direction D5 and outputs detection result data indicating a detection result. The detection result data output from the detection portion 44 is input to the control portion 7. It is noted that the detection portion 44 may alternatively be transmission-type light sensors that are arranged along the width direction D5.

Incidentally, there is known an image forming apparatus in which the end portion 41A of the correction roller pair 41 is moved to the reference position P1 (see FIG. 3) every time the position of the sheet SH in the width direction D5 is corrected using the correction roller pair 41.

However, with the configuration in which the end portion 41A of the correction roller pair 41 is moved to the reference position P1 every time the position of the sheet SH in the width direction D5 is corrected, the correction roller pair 41 cannot be used to convey the sheet SH until the end portion 41A of the correction roller pair 41 is moved to the reference position P1 and stops. Therefore, with the configuration described above, conveying intervals of the sheets SH become long.

In contrast, in the image forming apparatus 100 according to the embodiment of the present disclosure, it is possible to correct the position of the conveyed sheet SH in the width direction D5 and also suppress a situation where the conveying intervals of the sheets SH become long as will be described below.

Configuration of Control Portion 7

Next, a configuration of the control portion 7 will be described with reference to FIG. 2.

As shown in FIG. 2, the control portion 7 includes a detection processing portion 51, a first movement processing portion 52, a record processing portion 53, an acquisition processing portion 54, a determination processing portion 55, a second movement processing portion 56, and a setting processing portion 57. The sheet conveying portion 4 and the control portion 7 are an example of a sheet conveying device according to the present disclosure. It is noted that the present disclosure may alternatively be applied to the ADF 1.

Specifically, an operation control program for causing the CPU 21 of the control portion 7 to function as the respective processing portions described above is stored in advance in the ROM 22 of the control portion 7. The CPU 21 of the control portion 7 executes the operation control program stored in the ROM 22 to function as the respective processing portions described above. It is noted that some or all of the processing portions included in the control portion 7 may be constituted of an electronic circuit. Further, the operation control program may alternatively be a program for causing a plurality of processors to function as the respective processing portions included in the control portion 7.

The detection processing portion 51 detects the deviation amount of the sheet SH conveyed by the correction roller pair 41 in the width direction D5.

For example, the detection processing portion 51 uses the detection portion 44 to detect the deviation amount. For example, the detection processing portion 51 acquires the deviation amount based on a position of one of the end portions of the sheet SH in the width direction D5 (the rear-side end portion in the front-rear direction D2) (see FIG. 3), that is specified by the detection result data, and a sheet reference position corresponding to a size of the sheet SH in the width direction D5.

For example, when the position of one of the end portions of the sheet SH in the width direction D5, that is specified by the detection result data, is more on the rear side of the front-rear direction D2 than the sheet reference position, the deviation amount takes a plus value. On the other hand, when the position of one of the end portions of the sheet SH in the width direction D5, that is specified by the detection result data, is more on the front side of the front-rear direction D2 than the sheet reference position, the deviation amount takes a minus value.

The first movement processing portion 52 causes the correction roller pair 41 that is nipping the sheet SH to move along the width direction D5 based on the deviation amount detected by the detection processing portion 51.

Specifically, when the deviation amount detected by the detection processing portion 51 takes a plus value, the first movement processing portion 52 causes the correction roller pair 41 that is conveying the sheet SH to move toward the front side of the front-rear direction D2 by the same amount as the deviation amount. Further, when the deviation amount detected by the detection processing portion 51 takes a minus value, the first movement processing portion 52 causes the correction roller pair 41 that is conveying the sheet SH to move toward the rear side of the front-rear direction D2 by the same amount as the deviation amount. In other words, the first movement processing portion 52 causes the correction roller pair 41 that is nipping the sheet SH to move such that one of the end portions of the sheet SH in the width direction D5 is arranged at the sheet reference position.

The record processing portion 53 records the deviation amount detected by the detection processing portion 51.

For example, the record processing portion 53 stores recording data including information indicating a detection date and time and information indicating a detection result in the storage portion 6 every time the deviation amount is detected by the detection processing portion 51.

The acquisition processing portion 54 acquires a separated distance between the position of the correction roller pair 41 after being moved by the first movement processing portion 52 and the reference position P1 (see FIG. 3).

Specifically, the acquisition processing portion 54 specifies the position of the correction roller pair 41 after being moved by the first movement processing portion 52 based on the position of the correction roller pair 41 before being moved by the first movement processing portion 52 and the detection result obtained by the detection processing portion 51. Then, the acquisition processing portion 54 acquires the separated distance based on the specified position of the moved correction roller pair 41.

When the correction roller pair 41 is moved by the first movement processing portion 52, the determination processing portion 55 determines whether or not a predetermined movement condition is satisfied.

For example, the movement condition includes the separated distance acquired by the acquisition processing portion 54 exceeding a predetermined threshold value.

It is noted that the movement condition may alternatively be the number of times of movement of the correction roller pair 41 by the first movement processing portion 52 reaching a predetermined reference number of times.

When determined by the determination processing portion 55 that the movement condition is satisfied, the second movement processing portion 56 causes the end portion 41A of the correction roller pair 41 (see FIG. 3) that has finished conveying the sheet SH to move to the reference position P1 (see FIG. 3).

For example, the second movement processing portion 56 causes the end portion 41A of the correction roller pair 41 to move to the reference position P1 using a sensor (not shown) that is capable of detecting a state where the end portion 41A of the correction roller pair 41 has reached the reference position P1.

The setting processing portion 57 sets the threshold value based on a result of the recording by the record processing portion 53.

For example, when ending the image forming processing for forming an image that is based on image data on the sheet SH, the setting processing portion 57 sets the threshold value based on a maximum value of the deviation amounts that have been detected during execution of the image forming processing. For example, the setting processing portion 57 sets a difference between the maximum value and the distance L1 (see FIG. 3) as the threshold value. Alternatively, when ending the image forming processing, the setting processing portion 57 may set the threshold value based on an average value of the deviation amounts that have been detected during execution of the image forming processing. Alternatively, the setting processing portion 57 may set the threshold value based on a maximum value of the deviation amounts that have been detected in the past.

It is noted that the setting processing portion 57 may alternatively set the threshold value based on a type of the sheet SH to be conveyed. In this case, table data indicating a correspondence relationship between the type of the sheet SH and a value to be set as the threshold value only needs to be stored in advance in the storage portion 6 or the ROM 22. In addition, when executing the image forming processing, the setting processing portion 57 only needs to specify the type of the sheet SH to be conveyed and set the threshold value based on the specified type of the sheet SH and the table data.

Operation Control Processing

Figure 4:
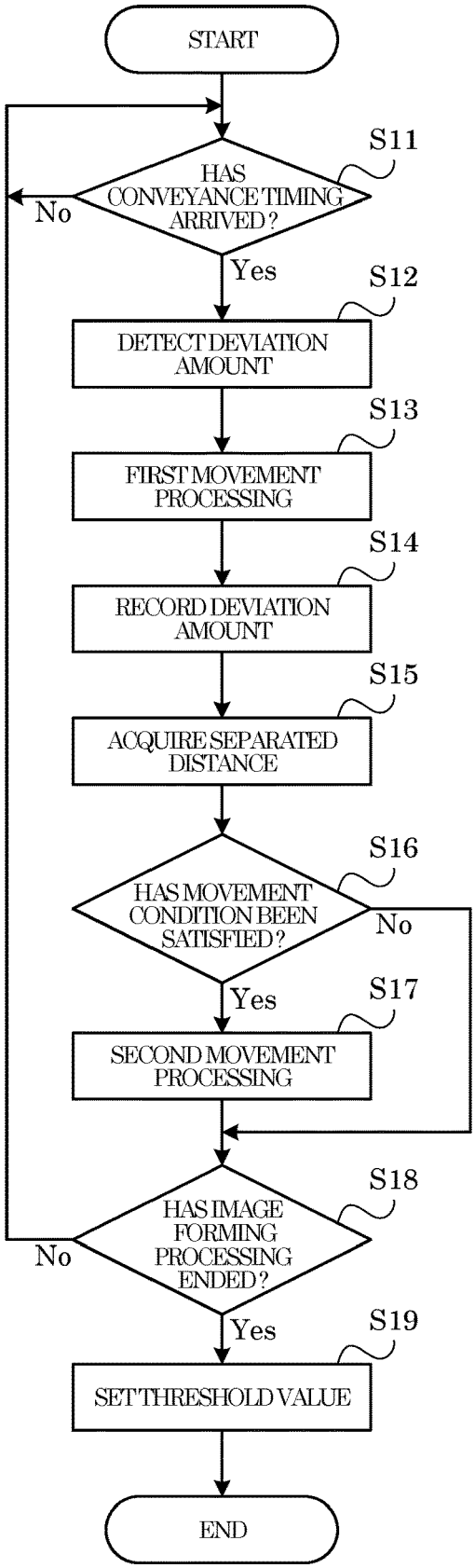
FIG. 4 is a flowchart showing an example of operation control processing executed in the image forming apparatus according to the embodiment of the present disclosure.

Next, with reference to FIG. 4, an operation control method according to the present disclosure will be described along with exemplary procedures of operation control processing executed by the control portion 7 in the image forming apparatus 100. When executing the image forming processing, the operation control processing is executed along with the image forming processing.

Step S11

First, in Step S11, the control portion 7 determines whether or not a conveyance timing at which the sheet SH is conveyed by the correction roller pair 41 has arrived.

Herein, when determining that the conveyance timing has arrived (Yes in S11), the control portion 7 shifts the processing to Step S12. On the other hand, when determining that the conveyance timing has not arrived (No in S11), the control portion 7 stands by for the arrival of the conveyance timing in Step S11.

Step S12

In Step S12, the control portion 7 detects the deviation amount of the sheet SH conveyed by the correction roller pair 41 in the width direction D5. Herein, the processing of Step S12 is an example of a detection step according to the present disclosure and is executed by the detection processing portion 51 of the control portion 7.

Specifically, the control portion 7 acquires the detection result data using the detection portion 44. Then, the control portion 7 acquires the deviation amount based on the position of one of the end portions of the sheet SH in the width direction D5 (the rear-side end portion in the front-rear direction D2), that is specified by the acquired detection result data, and the sheet reference position corresponding to the size of the sheet SH in the width direction D5.

Step S13

In Step S13, the control portion 7 executes first movement processing for moving the correction roller pair 41 that is nipping the sheet SH along the width direction D5 based on the deviation amount detected by the processing of Step S12. Herein, the processing of Step S13 is an example of a first movement step according to the present disclosure and is executed by the first movement processing portion 52 of the control portion 7.

Specifically, when the deviation amount detected by the processing of Step S12 takes a plus value, the control portion 7 causes the correction roller pair 41 that is conveying the sheet SH to move toward the front side of the front-rear direction D2 by the same amount as the deviation amount. On the other hand, when the deviation amount detected by the processing of Step S12 takes a minus value, the control portion 7 causes the correction roller pair 41 that is conveying the sheet SH to move toward the rear side of the front-rear direction D2 by the same amount as the deviation amount.

Step S14

In Step S14, the control portion 7 records the result of the processing of Step S12. Herein, the processing of Step S14 is executed by the record processing portion 53 of the control portion 7.

Specifically, the control portion 7 stores the recording data including information indicating a detection date and time of the processing of Step S12 and information indicating the deviation amount detected by the processing of Step S12 in the storage portion 6.

Step S15

In Step S15, the control portion 7 acquires the separated distance between the position of the correction roller pair 41 after being moved by the first movement processing and the reference position P1 (see FIG. 3). Herein, the processing of Step S15 is executed by the acquisition processing portion 54 of the control portion 7.

Specifically, the control portion 7 specifies the position of the correction roller pair 41 after being moved by the first movement processing based on the position of the correction roller pair 41 before being moved by the first movement processing and the detection result of the deviation amount obtained by the processing of Step S12. Then, the control portion 7 acquires the separated distance based on the specified position of the moved correction roller pair 41.

Step S16

In Step S16, the control portion 7 determines whether or not the movement condition is satisfied. Herein, the processing of Step S16 is an example of a determination step according to the present disclosure and is executed by the determination processing portion 55 of the control portion 7.

Specifically, the control portion 7 determines that the movement condition is satisfied when the separated distance acquired by the processing of Step S15 exceeds the threshold value.

Herein, when determining that the movement condition is satisfied (Yes in S16), the control portion 7 shifts the processing to Step S17. On the other hand, when determining that the movement condition is not satisfied (No in S16), the control portion 7 shifts the processing to Step S18.

Step S17

In Step S17, the control portion 7 executes second movement processing for moving the end portion 41A of the correction roller pair 41 (see FIG. 3) that has finished conveying the sheet SH to move to the reference position P1 (see FIG. 3). Herein, the processing of Step S17 is an example of a second movement step according to the present disclosure and is executed by the second movement processing portion 56 of the control portion 7.

Specifically, the control portion 7 causes the end portion 41A of the correction roller pair 41 to move to the reference position P1 using the sensor (not shown) that is capable of detecting a state where the end portion 41A of the correction roller pair 41 has reached the reference position P1.

Step S18

In Step S18, the control portion 7 determines whether or not the image forming processing has ended.

Herein, when determining that the image forming processing has ended (Yes in S18), the control portion 7 shifts the processing to Step S19. On the other hand, when determining that the image forming processing has not ended (No in S18), the control portion 7 shifts the processing to Step S11.

Step S19

In Step S19, the control portion 7 sets the threshold value based on the detection result of the deviation amount obtained during execution of the image forming processing. Herein, the processing of Step S19 is executed by the setting processing portion 57 of the control portion 7.

Specifically, the control portion 7 sets a difference between the maximum value of the deviation amounts that have been detected during execution of the image forming processing and the distance L1 (see FIG. 3) as the threshold value. Thus, in the image forming processing to be executed next, the positional deviation can be eliminated as long as the deviation amount of the sheet SH in the width direction D5 does not exceed the maximum value.

In this manner, in the image forming apparatus 100, whether or not the movement condition is satisfied is determined when the correction roller pair 41 is moved. Then, when determined that the movement condition is satisfied, the correction roller pair 41 that has fished conveying the sheet SH is moved to the reference position P1. Thus, it is possible to correct the position of the conveyed sheet SH in the width direction D5 and also suppress a situation where the conveying intervals of the sheets SH become long as compared to the configuration in which the correction roller pair 41 is moved to the reference position P1 every time the position of the sheet SH in the width direction D5 is corrected.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet conveying device, comprising:

a pair of conveying members which nip and convey a sheet, the pair of conveying members being movably provided along a width direction of the sheet orthogonal to a conveying direction of the sheet;

a detection processing portion which detects a deviation amount of the sheet conveyed by the pair of conveying members in the width direction;

a first movement processing portion which causes the pair of conveying members that are nipping the sheet to move along the width direction based on the deviation amount detected by the detection processing portion;

a determination processing portion which determines whether or not a predetermined movement condition is satisfied when the pair of conveying members are moved by the first movement processing portion;

a second movement processing portion which causes, when determined by the determination processing portion that the movement condition is satisfied, the pair of conveying members that have finished conveying the sheet to move to a predetermined reference position; and an acquisition processing portion which acquires a separated distance between a position of the pair of conveying members after being moved by the first movement processing portion and the reference position, wherein the movement condition includes the separated distance acquired by the acquisition processing portion exceeding a predetermined threshold value.

2. The sheet conveying device according to claim 1, further comprising:

a record processing portion which records the deviation amount detected by the detection processing portion; and a setting processing portion which sets the threshold value based on a result of the recording by the record processing portion.

3. The sheet conveying device according to claim 1, further comprising:

a setting processing portion which sets the threshold value based on a type of the sheet to be conveyed.

4. An image forming apparatus, comprising:

the sheet conveying device according to claim 1; and an image forming portion which forms an image on the sheet conveyed by the sheet conveying device.

5. An operation control method executed in a sheet conveying device including a pair of conveying members which nip and convey a sheet, the pair of conveying members being movably provided along a width direction of the sheet orthogonal to a conveying direction of the sheet, the operation control method comprising:

a detection step of detecting a deviation amount of the sheet conveyed by the pair of conveying members in the width direction;

a first movement step of causing the pair of conveying members that are nipping the sheet to move along the width direction based on the deviation amount detected by the detection step;

a determination step of determining whether or not a predetermined movement condition is satisfied when the pair of conveying members are moved by the first movement step;

a second movement step of causing, when determined by the determination step that the movement condition is satisfied, the pair of conveying members that have finished conveying the sheet to move to a predetermined reference position; and an acquisition processing step of acquiring a separated distance between a position of the pair of conveying members after being moved by the first movement step and the reference position, wherein the movement condition includes the separated distance acquired by the acquisition processing step exceeding a predetermined threshold value.

* * * * *